US005423476A

United States Patent [19]

Ferrer

[11] Patent Number: 5,423,476

[45] Date of Patent: Jun. 13, 1995

[54] CUP WITH INTEGRAL STRAW

[76] Inventor: Lilly Ferrer, 203 Radcliff Rd., Island Park, N.Y. 11558

[21] Appl. No.: 151,976

[22] Filed: Nov. 15, 1993

[51] Int. Cl.[6] ..... B65D 3/06; B65D 21/02

[52] U.S. Cl. ..... 229/404; 229/103.1

[58] Field of Search ..... 229/1.5 B, 103.1; 215/1 A

[56] References Cited

U.S. PATENT DOCUMENTS

| | | | |
|---|---|---|---|
| 1,213,961 | 1/1917 | Shepard | 229/103.1 |
| 2,487,100 | 11/1949 | Cohen | 229/103.1 |
| 2,581,516 | 1/1952 | Cohen | 229/103.1 |
| 2,948,453 | 8/1960 | Drown | 229/103.1 |
| 3,921,889 | 11/1975 | Gibbons | 229/103.1 |
| 4,043,478 | 8/1977 | Duncan | 229/103.1 |
| 4,714,173 | 12/1987 | Ruiz | 229/103.1 |
| 4,830,204 | 5/1989 | Lin | 229/103.1 |

*Primary Examiner*—Stephen P. Garbe

*Attorney, Agent, or Firm*—Charles E. Temko

[57] ABSTRACT

A drinking cup of impregnated paper or similar material in which the side wall element includes additional material at one vertical edge thereof which is folded upon itself to form a drinking straw extending from the bottom of the interior of the cup to a level above the upper rim of the cup. The straw is foldable within a slot in the cup when not in use to enable the cup to be closed by a lid. The lid is provided with an opening which permits the straw to be erected to operative condition and the contents of the cup consumed without removing the lid.

3 Claims, 2 Drawing Sheets

CUP WITH INTEGRAL STRAW

BACKGROUND OF THE INVENTION

This invention relates generally to the field of disposable containers for comestible fluids such as soft drinks and the like, and more particularly to an improved impregnated paper type commonly used in fast food establishments for consumption on or off the premises. Typically, such containers are in the form of a frusto-conically shaped cup having a planar bottom wall sealed to a tapered side wall adjacent a lower edge thereof, the side wall terminating at an upper end thereof in a rolled bead. A flexible synthetic resinous cover encloses the upper end and has a peripheral flange which engages the bead at the upper edge of the side wall. The cover often includes a slotted flexible area which is pierced by a conventional drinking straw to enable drinking of the contents of the cup without removing the cover. Straws are usually provided in a separate dispenser near the serving area. During periods of active sales activity, replenishment of exhausted straw dispensers is often forgotten, resulting in the customer being without the convenience of having a straw. It is known in the art to provide cups having integrated straw construction, but such constructions have not enjoyed substantial public acceptance owing to a number of disadvantages involved both in the manufacture of the cup and the use of the cup by a consumer. The latter problem stems from the fact that once the straw is in position, it is either not possible to engage a cover or lid, or in the case of some earlier constructions, the upper end of the straw terminates at the upper edge of the cup necessitating direct engagement of the upper edge of the cup with the lips of the user. It is known to provide a construction in which the straw is movable relative to the cup, but such provision entails substantially increased costs in fabrication, and seriously hinders the ability of the cup to be stacked or nested prior to use.

SUMMARY OF THE INVENTION

Briefly stated, the present invention contemplates the provision of an improved soft drink container of the class described which incorporates an integral drinking straw formed from the material comprising the side wall of the container. The blank of material, usually of impregnated paper, is formed to include a peripheral length somewhat greater than that of the completed cup, and prior to assembly, the excess material is folded upon itself to form an elongated channel through which the contents of the cup are aspirated by the user in normal fashion. The channel may be flattened to permit folding of the straw in the area adjacent to the upper ring leaving part of the folded straw outwardly of the cup so that the cup may be closed by a conventional closure, the closure having a gap in the side wall thereof to accommodate the additional bulk of the straw when folded, and permitting the straw to be erected to operative condition without the necessity of removing the closure.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
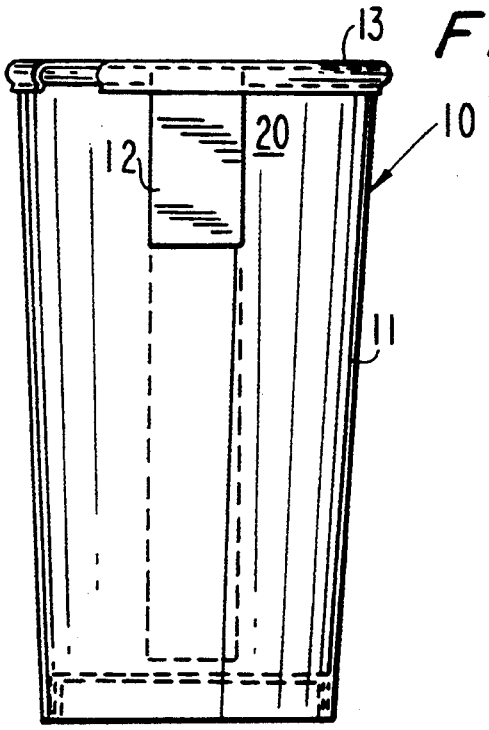
FIG. 1 is a side elevational view of an embodiment of the invention in closed condition.
Figure 2:
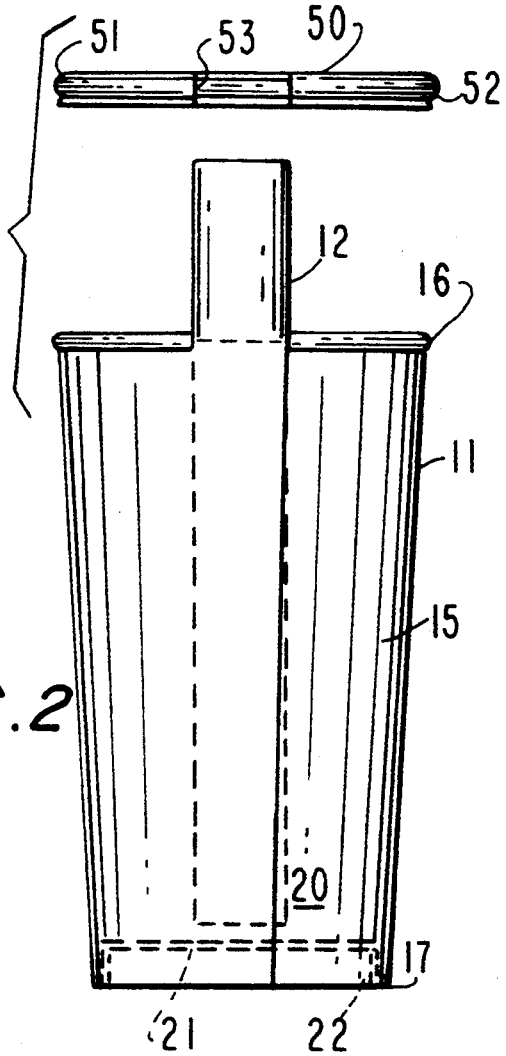
FIG. 2 is a similar side elevational view showing the removal of a cover element and the straw erected to operative condition.
Figure 3:
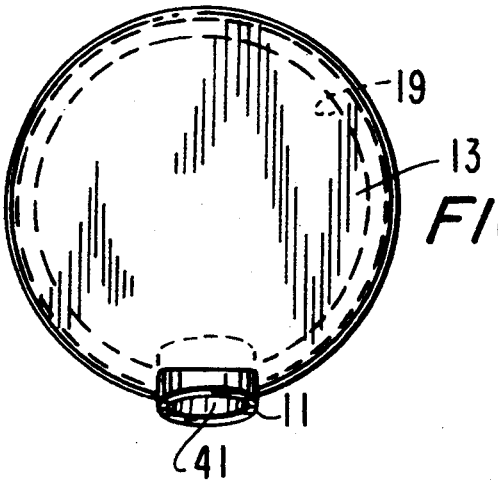
FIG. 3 is a top plan view thereof.

In accordance with the invention, the device, generally indicated by reference character 10 comprises broadly, a cup element 11, a straw element 12, and a cover element 13.

The cup element 11 includes a frusto-conical wall 15 bounded by an upper beaded edge 16, a lower crimped edge 17, an inner surface 19 and an outer surface 20. Interconnected at the crimped edge 17 is a planar lower wall 21 having a circular peripheral edge 22 for this purpose.

Figure 4:
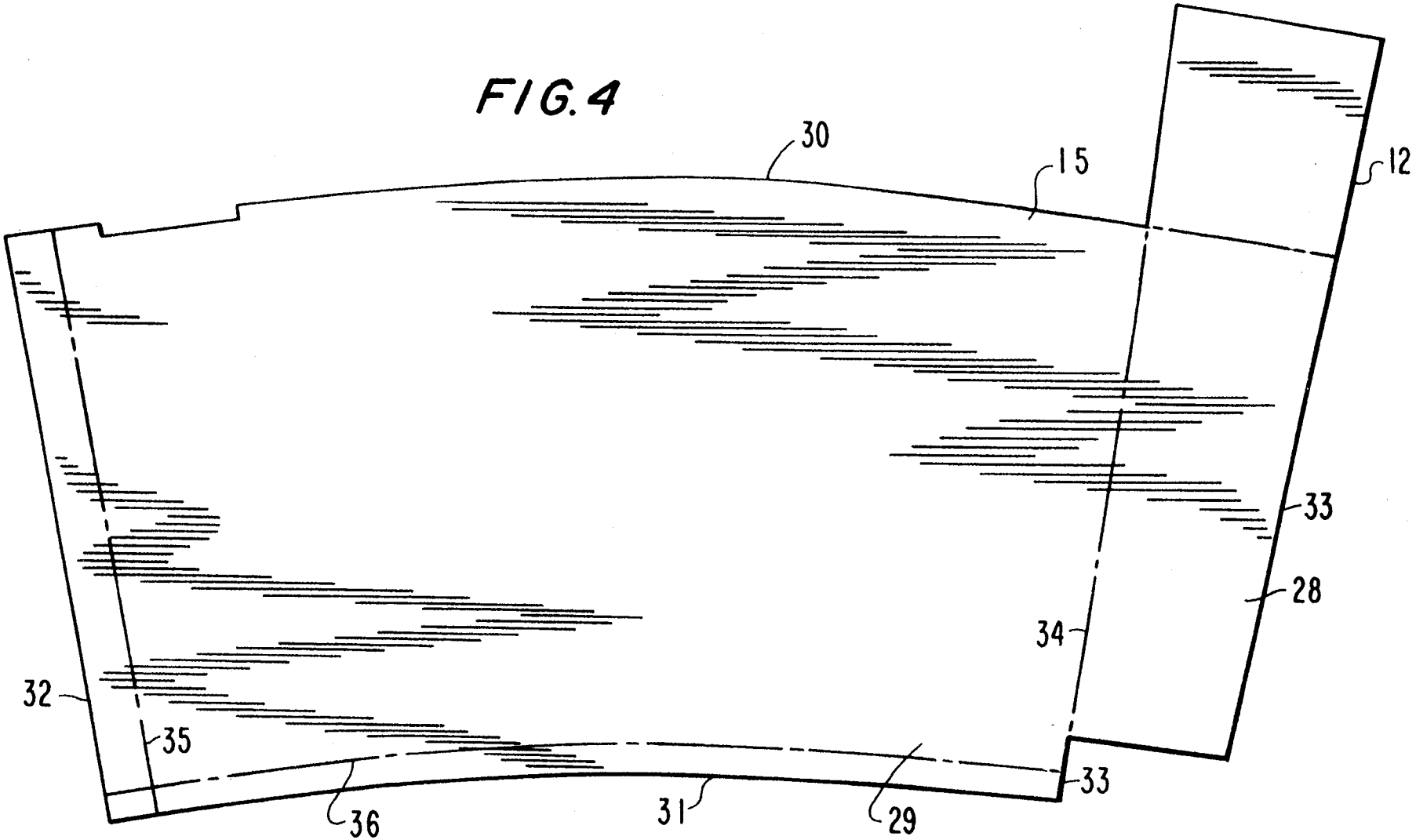
FIG. 4 is a developed view of a paper blank forming a side wall of the embodiment prior to assembly.

The straw element 12 is formed integrally with the wall 15, at one end 28 of a planar blank material 29 (FIG. 4) which forms the side wall. The blank is bounded by an upper edge 30, a lower edge 31, free longitudinal edges 32 and 33, a short longitudinal fold edge 34, a long longitudinal fold edge 35, and a transverse fold edge 36. The blank is assembled by first forming the straw element 12, sealing the same longitudinally, and subsequently forming the wall 15 in known manner, integrating the lower wall 21 at the time the lower edge 17 is crimped using non-toxic water proof synthetic resinous glues.

With assembly, the interconnection longitudinally of the straw element 11 forms a suction channel 41 which will project upwardly from the upper beaded edge 16. The edge 16 is interrupted over an arcuate distance sufficient to permit the straw element 12 to be folded through approximately 180 degrees wherein the upper portion thereof lies alongside the outer surface 20 of the cup element 11. This fold is preferably accomplished by mechanically crimping, so that it will remain in collapsed condition until the cup element is nested with similar cup elements for storage.

The cover element 13 is generally conventional, including a planar end wall 50 bounded by a peripheral edge 51 and a resilient downwardly extending flange 52 which forms a side wall. A portion of the side wall 53 is removed which corresponds in arcuate length to that of the folded straw element.

When the cup is put into use, it will normally be filled with a comestible liquid, and the cover element 13 will be positioned without regard to its angular orientation. When the contents of the cup are to be consumed, the cover may be positioned by the user so that the interrupted portion of the side wall will be aligned with the straw element, so that it may be erected for use with the cover element remaining in place, the upper end of the straw element projecting thereabove.

It will be observed that the disclosed construction offers several advantages over prior art constructions. A first is the fact that the cup may be fabricated with the straw element integrally formed such that it may be transversely folded to lie outside of the interior of the cup and adjacent the outer surface thereof so that it may be readily nested for storage without difficulty. When the cup is readied for use, the straw is returned to its original rectilinear configuration so that the upper end of the straw may project above the upper end of the cup. This enables the straw element to be formed integrally, rather than separately. By providing a recess in the beaded edge, the folded edge of the straw element may be disposed at or below the beaded edge to permit the positioning of a cover once the cup has been filled. By providing a corresponding interruption in the side wall of the cover, it is possible to reposition the cover upon the cup after erection of the straw element to permit drinking with the cover in place, thus avoiding the possibility of spillage. Above all, the present construction permits fabrication by known methods using existing machinery, thereby permitting the cost of fabrication to remain at a reasonably low level.

I wish it to be understood that I do not consider the invention to be limited to the precise details of structure shown and set forth in the specification, for obvious modifications will occur to those skilled in the art to which the invention pertains.

I claim:

1. An improved cup construction for soft drinks and similar comestibles comprising: a frusto-conical side wall including an upper beaded edge and a lower crimped edge, a planar bottom wall sealed within said lower crimped edge to form a liquid container; said side wall being formed from a planar blank of flexible material having inner and outer surfaces, an upper edge and a lower edge, a free side edge and a fold line extending between said upper and lower edges; an integral straw element extending outwardly of said fold line of generally rectangular configuration, said straw element extending upwardly of said upper edge and downwardly to the area of said lower wall, said straw element being longitudinally foldable upon itself to form a channel for the passage of liquid from the interior of said container; said straw element being bounded by a free longitudinal edge and said fold line and being interconnected together in the area of said free longitudinal edge and said fold line to enclose said channel; said blank being interconnected in the area of said first mentioned free edge and said fold edge to enclose said straw element; said straw element having a transversely extending fold line to enable the folding of said straw at said upper edge of said container, wherein the part of the straw element disposed thereabove may be positioned alongside the outer surface of said container; said upper edge of said container having a recess to accommodate said transversely extending fold line and enable the positioning of a cover thereupon.

2. An improved cup construction in accordance with claim 1, further comprising a cover element engageable with said container at said upper edge, said cover element including a planar end wall and a peripheral rim, said rim having a recessed portion to accommodate said transverse fold of said straw element.

3. An improved cup construction in accordance with claim 2, in which said cover element includes a recessed area to enable erection of the straw element to operative condition without disengaging the cover element.

* * * * *